US005630518A

United States Patent [19]

Collins

[11] Patent Number: 5,630,518

[45] Date of Patent: May 20, 1997

[54] MERCHANDISING DISPLAY

[76] Inventor: Larry D. Collins, 1999 Avenue of the Stars, Ste. 2800, Los Angeles, Calif. 90067

[21] Appl. No.: 433,831

[22] Filed: May 4, 1995

[51] Int. Cl.[6] ..... A47F 3/14

[52] U.S. Cl. ..... 211/132.1

[58] Field of Search ..... 211/132, 194, 211/188, 133; 248/174; 108/91, 165

[56] References Cited

U.S. PATENT DOCUMENTS

| | | | |
|---|---|---|---|
| 3,836,104 | 9/1974 | Miller et al. | 248/174 X |
| 4,574,960 | 3/1986 | Shikatani | 211/194 X |
| 4,911,311 | 3/1990 | Nagai | 211/132 X |
| 5,161,699 | 11/1992 | Hanna et al. | 211/132 |
| 5,513,745 | 5/1996 | Zoltan et al. | 211/132 X |

*Primary Examiner*—Kenneth J. Dorner
*Assistant Examiner*—Jerry Redman
*Attorney, Agent, or Firm*—Kelly, Bauersfeld & Lowry

[57] ABSTRACT

A merchandising display formed of assembled corrugated paperboard blanks is provided. The display is capable of adjustment to considerable and variable height. The display includes a base for supporting the display and for interlocking with at least one modular tray into which merchandise is stocked. Interlocking inserts secured in the trays form continuous vertical columns by which a plurality of trays may be supported on the base. A header may also be included. A counter display formed from an easel and at least one tray is also provided.

16 Claims, 7 Drawing Sheets

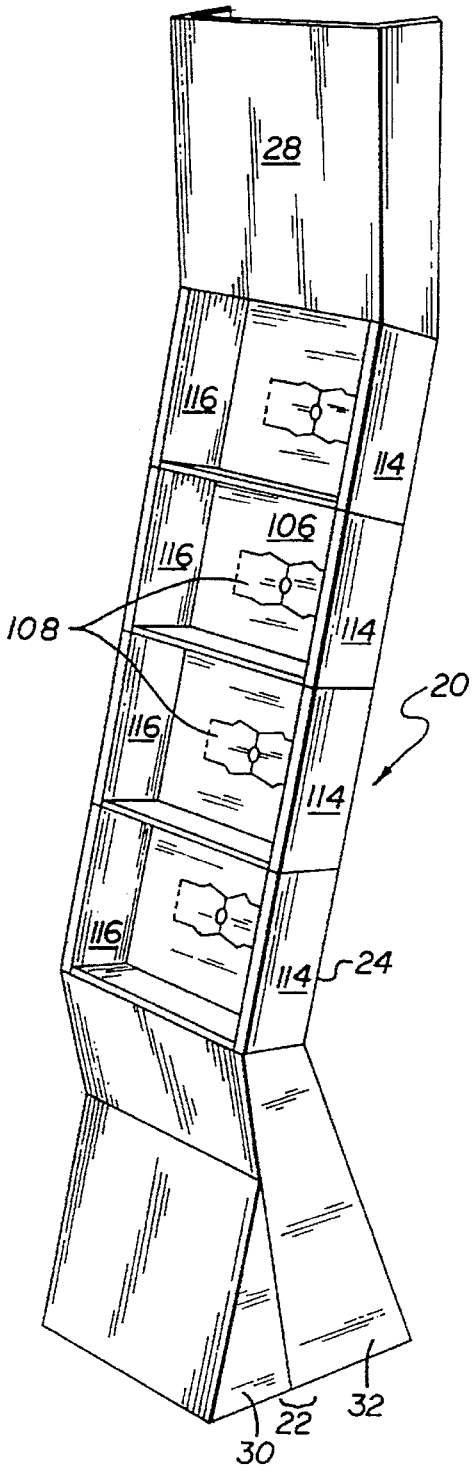
FIG. 3
FIG. 4
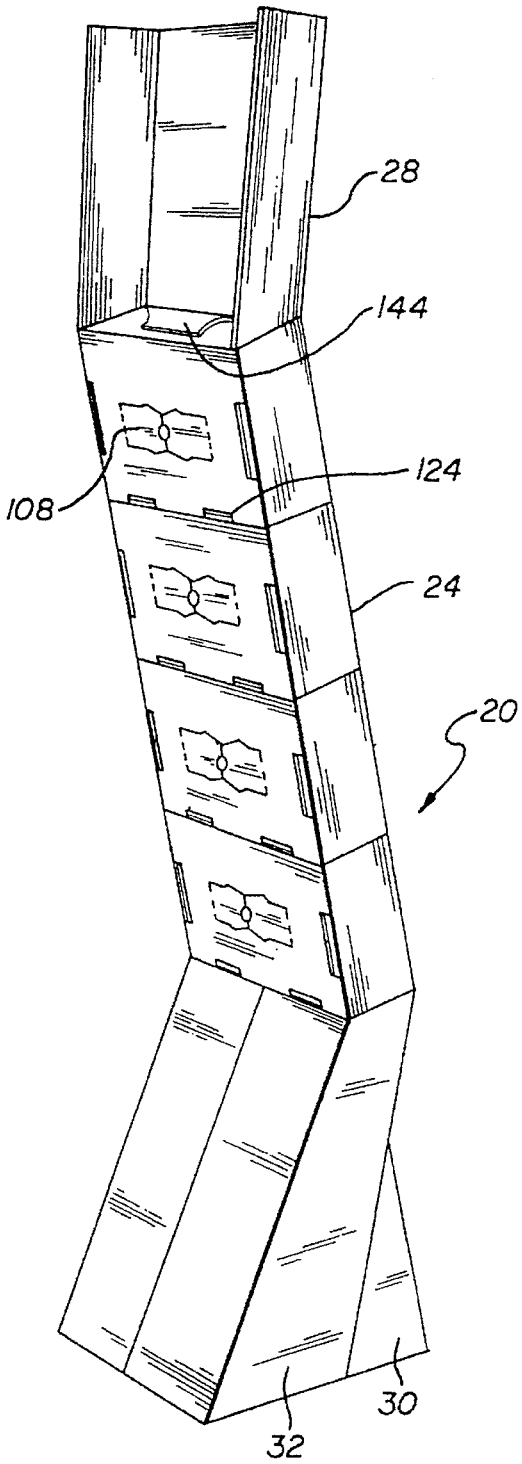

FIG. 12
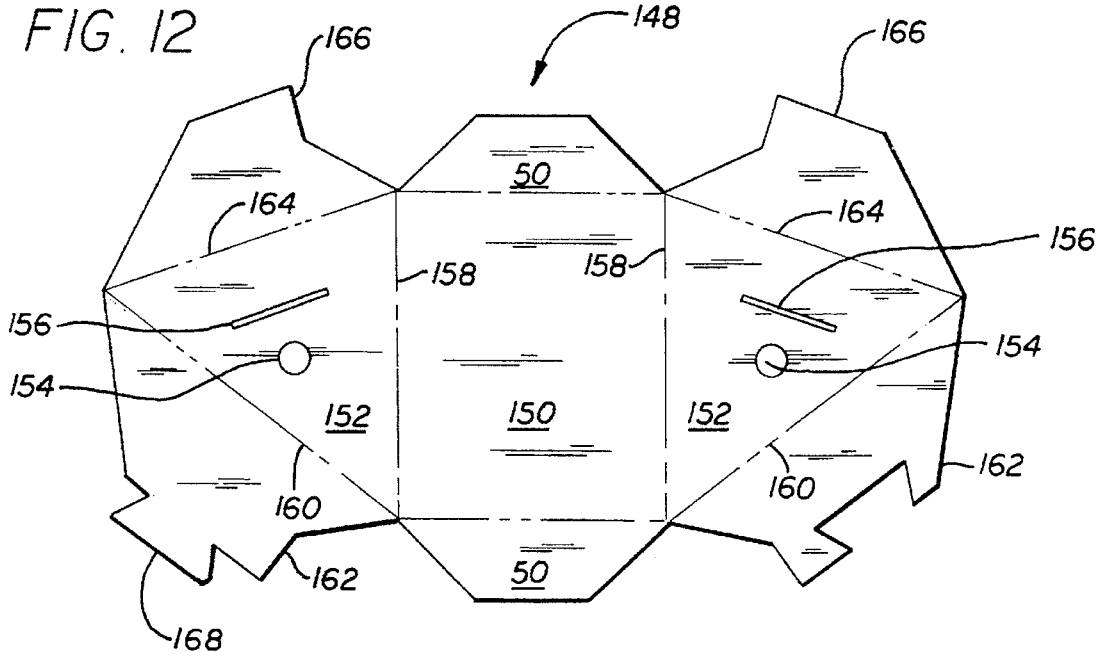
FIG. 13
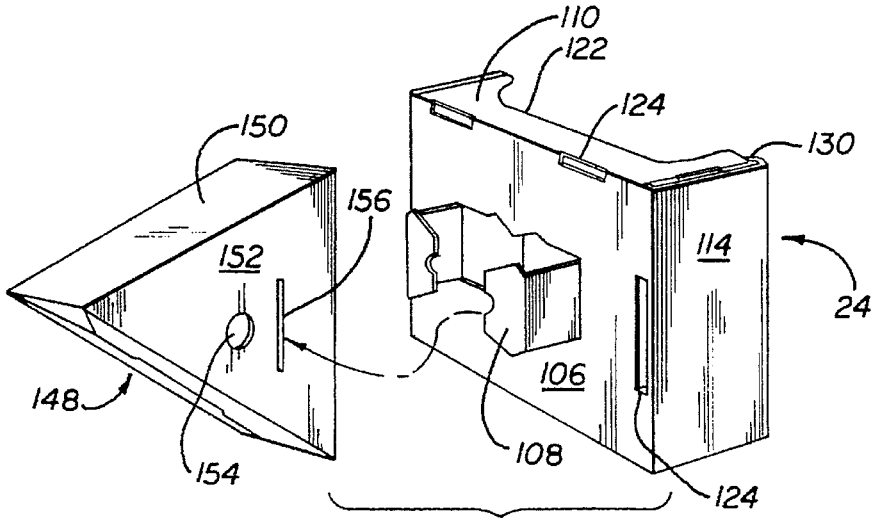
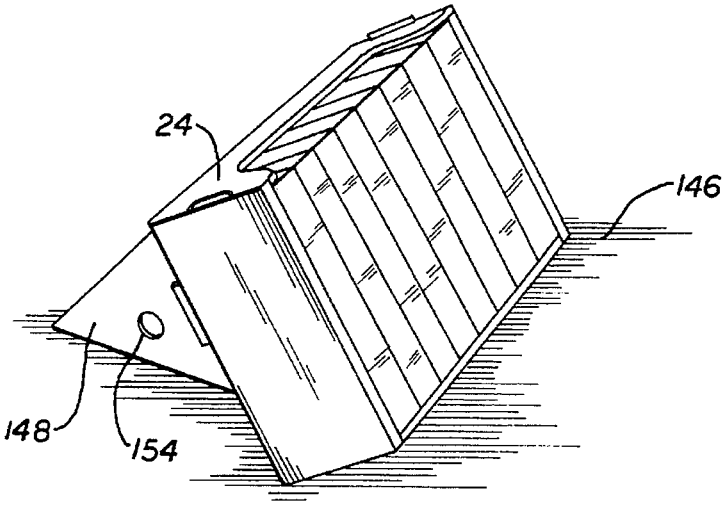
FIG. 14

MERCHANDISING DISPLAY

FIELD OF THE INVENTION

The present invention relates generally to point-of-purchase displays. More specifically, this invention relates to a merchandising display having modular trays in which the merchandise is stocked, the display capable of being stacked to considerable and variable height and width without collapsing or becoming unstable.

BACKGROUND OF THE INVENTION

Merchandising displays used at the point of purchase should attractively present the displayed product and give it maximum product visibility by putting the products at eye level. The displays must provide easy access to the displayed product for ease of handling by the purchaser. They must also accommodate a large enough volume of product to eliminate the need for constant restocking. Merchants are concerned that large displays take up too much floor space, are obtrusive, and difficult to move around to suit their needs. In a diverse business, they must display a wide assortment of products. For example, point-of-purchase display products may include multimedia products, cosmetics, books, batteries, etc. The displays are generally used repeatedly and are kept at the merchants' place of business.

Conventional displays have often comprised shelving structures that occupy a substantial amount of floor space and are often in a fixed location thereby making their arrangement and placement inflexible.

In recognition of this problem, there have been attempts to make displays of transportable lightweight materials such as corrugated cardboard, etc. However, these displays, although capable of disassembly, are usually of fixed inflexible configurations. The merchant cannot adapt the display to particular products or space considerations.

Accordingly, there has been a need for a versatile merchandising display that is of simplified construction and relatively inexpensive. There is a further need for a display with a configuration that can be adjusted depending on its use and location. There is a still further need for a display that is itself attractive but unobtrusive yet presents the displayed product attractively. Further, a display is needed that can be easily assembled and disassembled into relatively small components requiring little storage space. There is a still further need for a stable streamlined display that can be fully stocked without danger of collapsing or becoming unstable. The present invention fulfills these needs and provides other related advantages.

SUMMARY OF THE INVENTION

The present invention resides in an improved stable merchandising display. Each component of the display is formed from a folded corrugated paperboard blank divided by cut lines and score lines to define a plurality of panels. The display is capable of adjustment to considerable and variable height making it versatile for a wide assortment of uses and locations. In addition to this versatility, the display can easily be moved from one location to another and if use is temporarily discontinued, broken down into relatively small, flat easily-stored components.

In the preferred form, the display comprises, generally, base means for supporting the display on the floor and interlocked to at least one modular tray into which the merchandise is stocked. Interlocking inserts secured in the trays form continuous vertical columns by which a plurality of trays may be supported on the base. A header may also be included in the display for merchandising purposes.

In an alternative embodiment, at least one tray component may be attached to an easel for use as a counter top display.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is a second perspective view similar to FIG. 1, illustrating the display with the videotape cassettes removed;

FIG. 4 is a perspective view similar to FIG. 1, illustrating the merchandising display from the rear;

FIG. 12 is a plan view of an unfolded paperboard blank from which an easel for use in an alternative embodiment as a counter top display is constructed;

FIG. 13 is an exploded perspective view of the alternative embodiment of the counter top display in accordance with the present invention, illustrating the manner in which the easel is secured to a modular tray; and FIG. 14 is a perspective view of the counter top display of FIG. 13, illustrating its placement on a counter and the display of exemplary videotape cassettes.

DETAILED DESCRIPTION OF THE PREFERRED EMBODIMENTS

Figure 1:
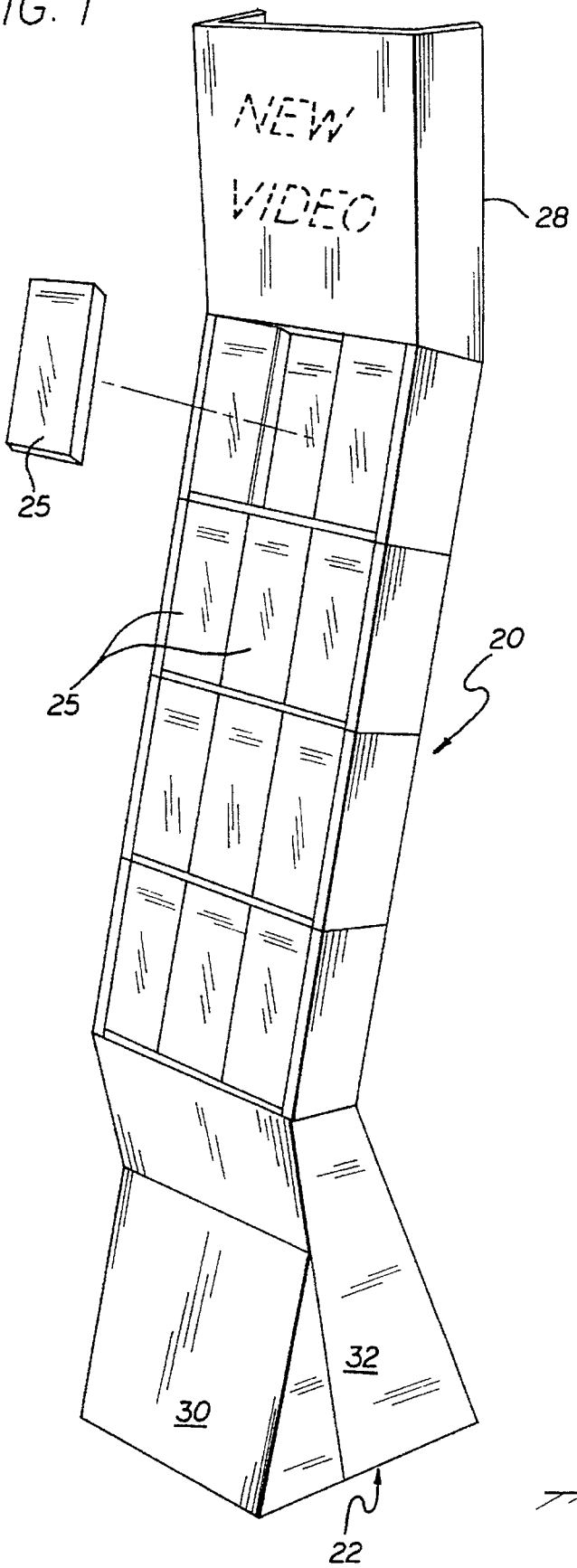
FIG. 1 is a perspective view of a floor merchandising display in accordance with the present invention, illustrating the manner in which the display may be fully stocked with articles such as videotape cassettes.
Figure 2:
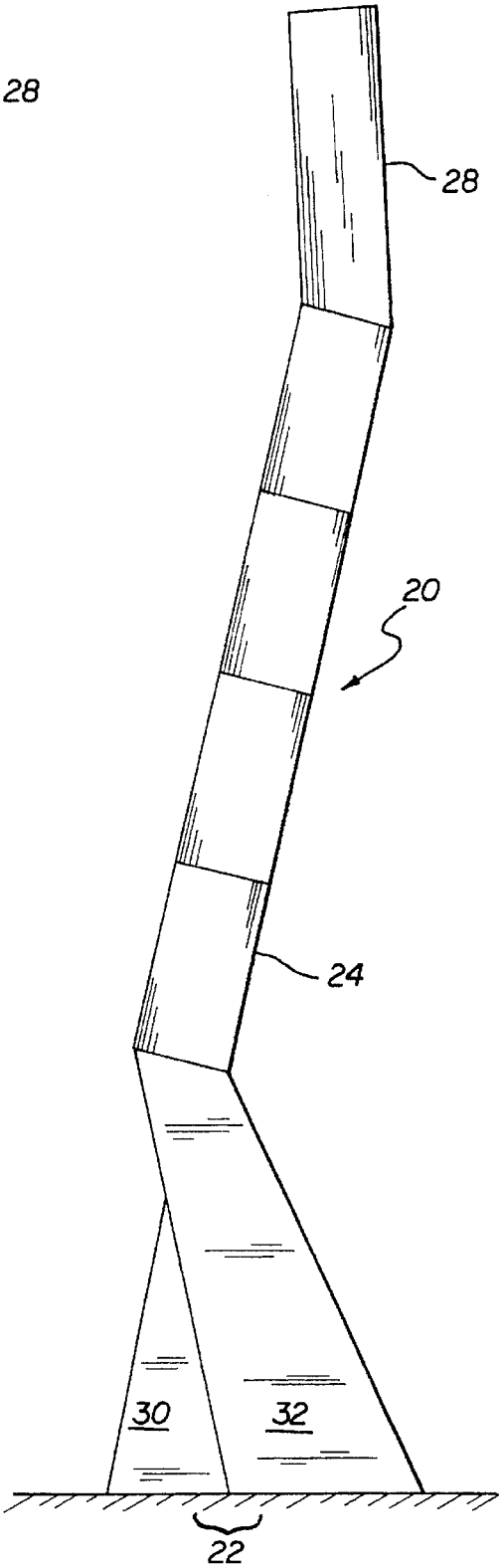
FIG. 2 is a left side elevational view of the display of FIG. 1.

As shown in the drawings for purposes of illustration, the present invention is concerned with an improved merchandising display, generally designated in the accompanying drawings by the reference number 20. The merchandising display 20 comprises, generally, a base 22 which has a generally triangular-shaped side profile and is positioned on the floor to support the display, at least one modular tray 24 into which merchandise such as video tape cassettes 25 is stocked, and interlocking column-forming members 26 secured in the trays 24 to form continuous vertical columns by which a plurality of trays may be supported on the base 22. A header 28 may also be included in the display for merchandising purposes. Each of the components of the display is formed of corrugated paperboard blanks divided by cut lines and score lines to define a plurality of panels, as described hereinafter.

Figure 10:
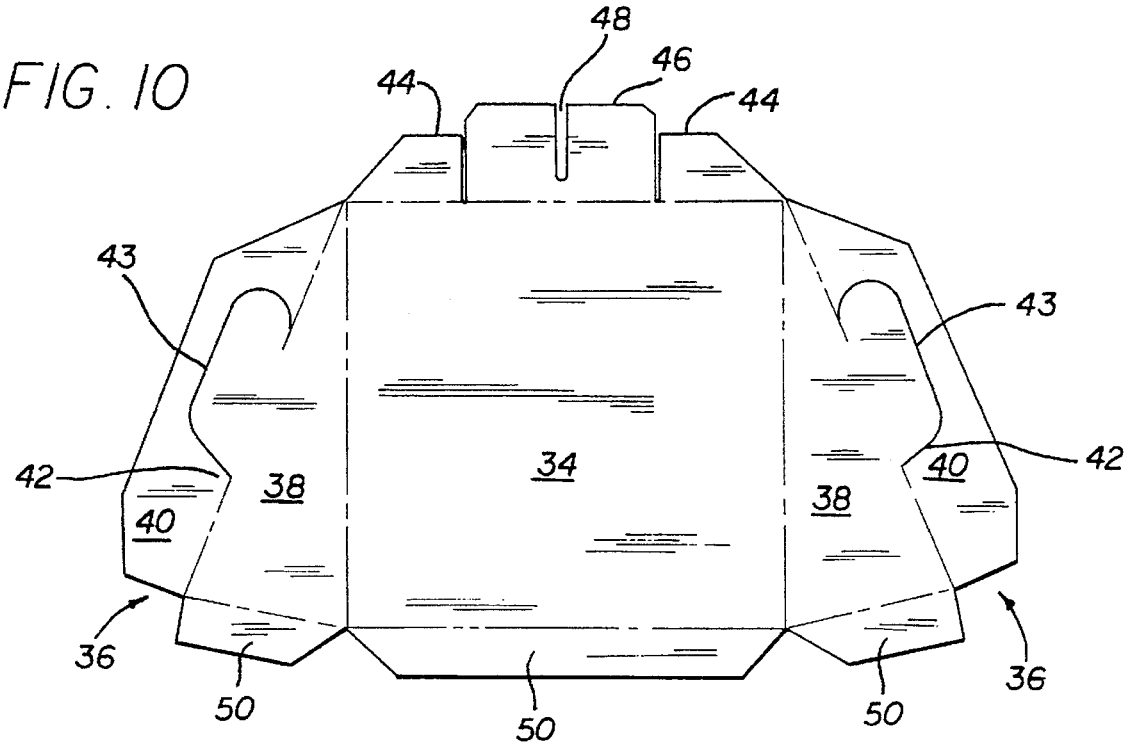
FIG. 10 is a plan view of an unfolded paperboard blank from which a front portion of the base is constructed.

The base 22 may have a two-piece (FIG. 5) or a one-piece construction (not shown). The two-piece base has a front portion 30 and a separate rear portion 32. The paperboard blank (FIG. 10) for the base front portion 30 includes a substantially square front panel 34. Attached to the vertical edges of the front panel 34 are two sidewalls 36. Each sidewall 36 includes a substantially triangular inner segment 38 joined directly to the front panel 34 and an outer segment 40 joined diagonally to the corresponding inner segment 38. There is a lobe-shaped cut-out 42 and a projecting tab 43 corresponding thereto in each of the outer segments 40 where the outer segments 40 join the inner segments 38. Joined at the top horizontal edge of the front panel are top tabs 44. The top tabs 44 are on either side of a projecting attachment tab 46 and are separate therefrom. The attachment tab 46 has an elongated U-shaped notch 48 therein at its upper edge. At the lower horizontal edge of the front panel 34 and the lower edge of the sidewall inner segments 38 are a plurality of bevelled flaps 50 that complete the base front portion blank. These base front portion components are interconnected to each other along scored fold lines shown in FIG. 10 in dot-dash form. This fold line notation in the drawings applies equally to the other components and figures described below.

The paperboard blank (FIG. 9) for the rear portion of the base 32 includes a relatively large vertically-oriented rectangular center panel 52. Attached to the longer vertical edges of the center panel 52 are two relatively large sidewalls 54. Each sidewall includes a substantially triangular inner segment 56 joined directly to the center panel 52, a substantially rectangular middle segment 58 joined directly on one longer edge to the inner segment 56 and joined directly on the opposite long edge to outer segments 60 and 62.

Figure 9:
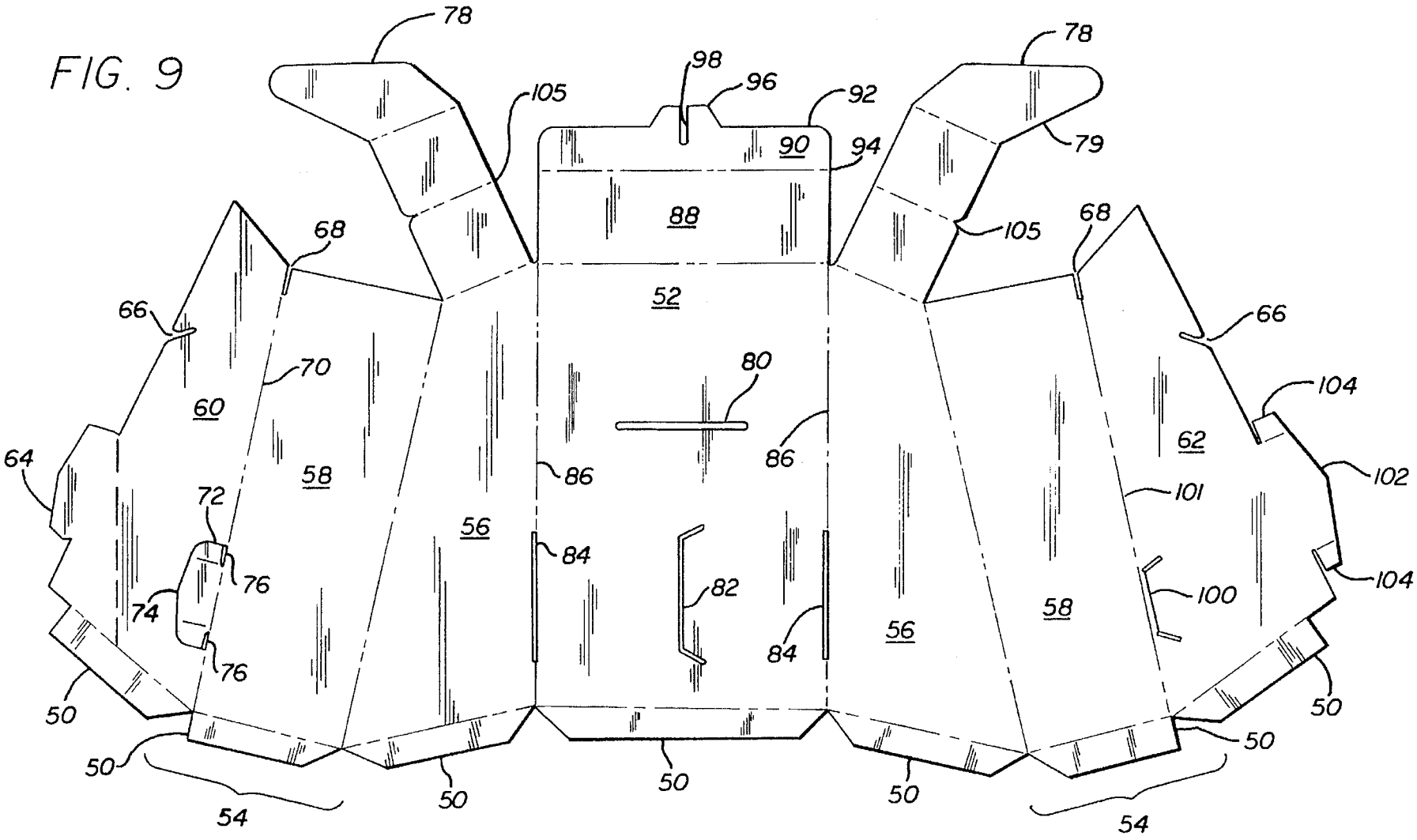
FIG. 9 is a plan view of an unfolded paperboard blank from which a rear portion of the base is constructed.

Starting at the left side of the blank as viewed in FIG. 9, the sidewall outer segment 60 includes a lobe-shaped tab 64 at the lower end of the outside edge of the segment 60. At the upper end of the outside edge is a notch 66 extending diagonally upwards into the outer segment 60. There is also a downwardly-extending notch 68 beginning from the top edge of the outer segment 60 and defined by a scored fold line 70 between the outer segment 60 and the middle segment 58. At the lower edge of the outer segment 60, where outer segment 60 joins middle segment 58, is a lobe-shaped opening 72 beginning at the score line 70 and extending into the outer segment 60. A corresponding lobe-shaped projecting tab 74 having foldable ends 76 cut-out from the opening 72 similarly begins at the score line 70. A tri-fold tab 78 having an outward curve 79 at its upper end is joined to the top edge of each inner segment 56. The center panel 52 has a horizontal slot 80 therein in its upper half. The lower half of the center panel 52 includes a vertical slot 82 having diagonally turned corners. A pair of slots 84 parallel and similarly sized in length to the vertical slot 82 are defined by the score lines 86 between the center panel 52 and each of the respective inner segments 56. A top flap 88 having a lip 90 is joined to the top horizontal edge of the center panel. The lip 90 has a free end 92 and a joined end 94. The free end 92 has an arcuate projecting tab 96 with an upright relatively large U-shaped notch 98 therein.

The opposite inner and middle segments 56 and 58 are identical to those previously described. The opposite outer segment 62 includes notches 66 and 68. There is a slot 100 having diagonal turned corners extending into the outer segment 62, the slot 100 formed in a scored fold line 101 between the middle and outer segments 58 and 62. The portion of the slot 100 formed in the scored fold line 101 is parallel and at approximately the same level as the center panel vertical slot 82. A dome-shaped tab 102 having foldable ends 104 is included at the lower end of the outside edge of the outer segment 62. At the bottom horizontal edges of the center panel 52 and sidewalls 54 are the bevelled flaps 50 that complete the blank for the base rear portion.

Figure 5:
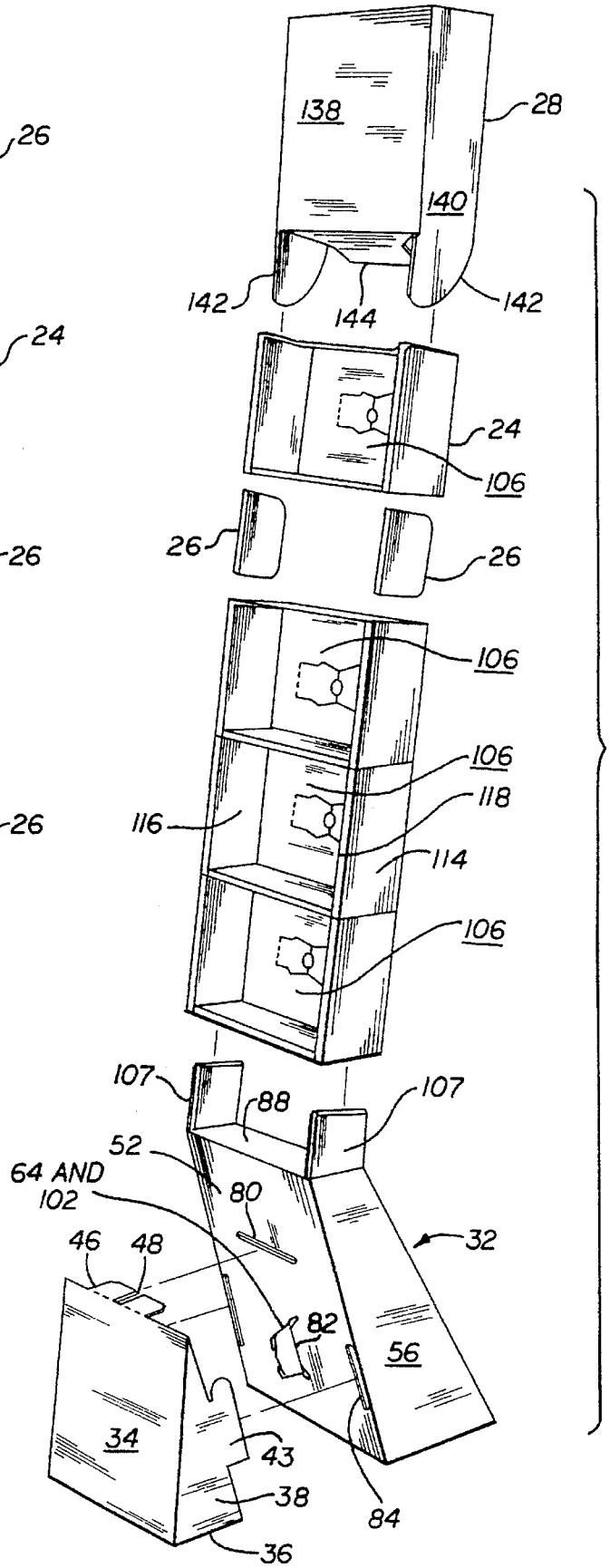
FIG. 5 is an exploded perspective view, illustrating the manner in which a plurality of modular trays are stacked on top of a base and interlocked to each other by a plurality of column-forming members, and a header interlocked with the uppermost tray.

To assemble the front portion of the base, reference is made to FIG. 5. The sidewalls 36 are bent at a 90 degree angle to the front panel 34. The outer segments 40 are bent at a 90 degree angle to the inner segments 38. The lobe-shaped projecting tabs 43 extend rearwardly from the inner segments 38 following assembly. The top tabs 44 are folded inwardly. The attachment tab 46 projects rearwardly.

To assemble the rear portion of the base, reference is also made to FIG. 5. The sidewalls 54 are bent rearwardly at a 90 degree angle to the center panel 52. The middle segments 58 are then bent at a 90 degree angle to the inner segments 56. The outer segments 60 and 62 are then bent inwardly at a 90 degree angle to the middle segments 58 such that the two middle segments 58 abut each other at the scored fold lines 70 and 101 and the outer segments 60 and 62 become interior panels laying against each other. The rear portion lobe-shaped projecting tab 74 is inserted into the slot 100. The lobe-shaped and dome-shaped tabs 64 and 102 are inserted against each other into the vertical slot 82 in the center panel 52. Once inserted, the ends 104 removably lock the assembled rear base portion together by preventing removal of tabs 64 and 102. The top flap 88 is bent rearwardly at a 90 degree angle to the center panel 52. The tri-fold tabs 78 are then folded inwardly along the score line 105 to form stacking members 107. The outward curve 79 is tucked inside the top of the rear portion behind the middle segments 58. The curve 79 of the tabs conforms to the inside such that the stacking members 107 are locked firmly in place. The lip 90 is tucked inside of the middle segments 56, the tab 96 and notch 98 therein fitting over the outer segments 60 and 62 which now fit against each other. The top flap 88 and lip 90 arrangement should tightly close off the upper part of the rear base portion.

When the front base portion 30 is secured to the rear base portion 34 as shown best in FIG. 5, the triangular side profile shape of the front portion 30 accommodates the lobe-shaped and dome-shaped tabs 64 and 102 which project forwardly into the hollow interior of the front portion 30. The lobe-shaped rearwardly projecting tabs 43 of the base front portion are inserted into the slots 84. The front portion attachment tab 46 is inserted into the horizontal slot 80 in the rear portion center panel 52. The attachment tab notch 48 receives the edges of the coplanar outer segments 60 and 62 that are in the inside of the rear base portion 32. The notches 66 in the outer segments 60 and 62 also grip the horizontal slot 80 for removably locking the rear base portion 32 together.

The bevelled flaps 50 of the base front and rear portions 30 and 32 are bent inwardly to provide an abutment surface between the floor and the display and to complete the generally triangular shape of the base. Furthermore, the top tabs 44 and the bevelled flaps 50 form a finished edge rather than a rough corrugated edge which would otherwise be visible to persons looking at the display. The corners of the flaps 50 are bevelled to avoid overlapping when the blanks are folded.

Figure 7:
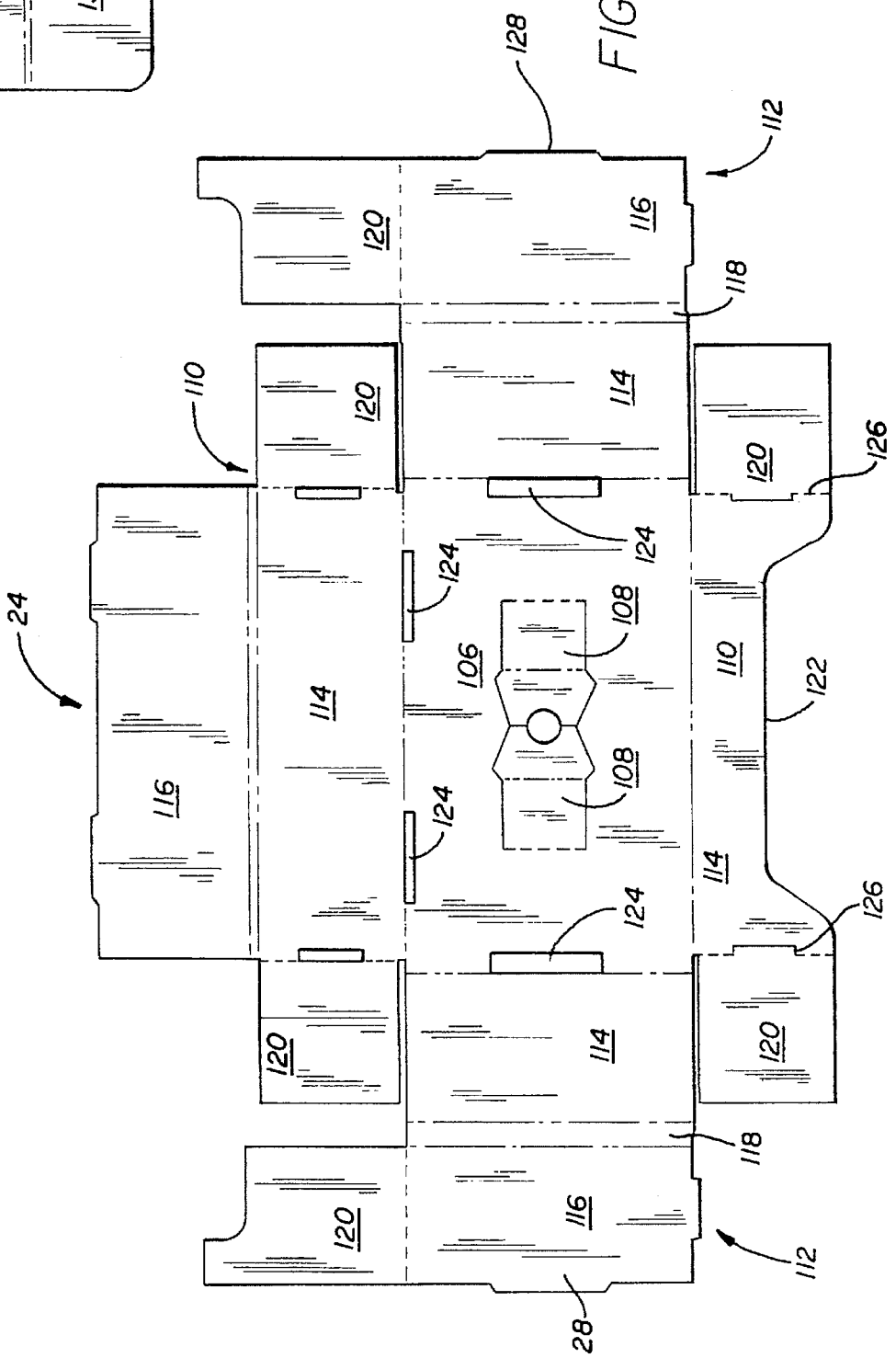
FIG. 7 is a plan view of an unfolded paperboard blank from which one of the modular trays is constructed.

A paperboard blank for one of the individual modular trays 24 (FIG. 7) includes a relatively large, rectangular rear wall 106 provided with optional attachment tabs 108 for use as shown in FIG. 13. Attached to the longer edges of the rear wall 106 are two sidewalls 110 while two endwalls 112 are attached to its shorter edges. Each sidewall and endwall 110 and 112 includes an outer segment 114 joined directly to the rear wall 106. Both endwalls 112 and one of the sidewalls 110 include an inner segment 116. The endwalls 112 are joined to the corresponding outer segment 114 by a long narrow strip 118. At both ends of the sidewall outer segment 114 and one end of each of the endwall inner segments 116 are supplement strengthening segments 120. One of the sidewalls includes a cutout 122. There are relatively wide positioning slots 124 cut longitudinally along the score lines joining the rear wall 106 to the endwall outer segment 114. Slots 124 are also included along the score line between the rear wall 106 and the sidewall having both inner and outer segments 114 and 116 as well as between the strengthening segments 120 and one of the sidewalls 110. The other sidewall 110 just has cut lines 126 between the strengthening segments 120 and the sidewall 110.

Figure 6:
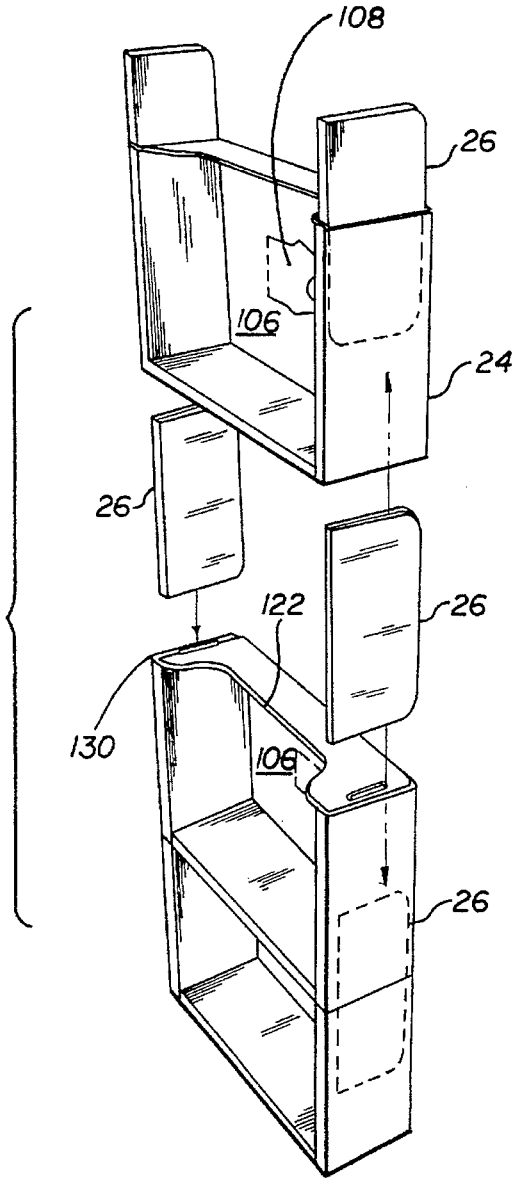
FIG. 6 is another exploded perspective view, illustrating the manner in which the trays are interlocked together by the column-forming members.

To assemble the tray 24, as shown in FIGS. 5 and 6, the outer segments 114 of the sidewall 110 and endwalls 112 are bent upwardly into a vertical position. The sidewall strengthening segments 120 are folded at a 90 degree angle to the outer sidewall segments 114 so that they will extend between the adjacent outer and inner endwall segments 114 and 116. To complete the assembly of the tray, the endwall strengthening segments 120 are folded against the inner endwall segment 116, the inner endwall segments 116 are folded down over the strengthening segments 120. Holding tabs 128 on the bottom edge of the inner wall segments 116 are inserted in the set of positioning slots 124 in the rear wall 106. The strengthening segments 120 thus are between the opposing surfaces of the outer and inner endwalls 112. The strip 118 forms a vertical slot 130 between the outer endwall segment and the inner endwall segment, these slots 130 being vertically aligned when the trays are stacked to receive the column-forming members 26.

Figure 8:
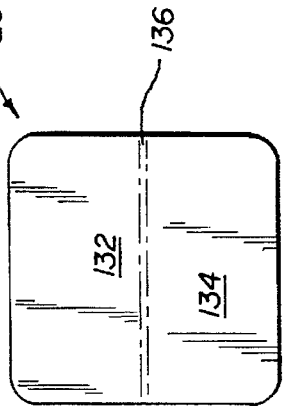
FIG. 8 is a plan view of an unfolded paperboard blank from which one of the column-supporting members is constructed.

The blank for the column-forming member 26 is shown in FIG. 8. The blank is substantially square and divided into top and bottom rectangular portions 132 and 134 joined by a long narrow strip 136. The column-forming member 26 is formed by folding the blank along the strip 136. The column-forming members are approximately the height of a single tray (FIG. 6).

Figure 11:
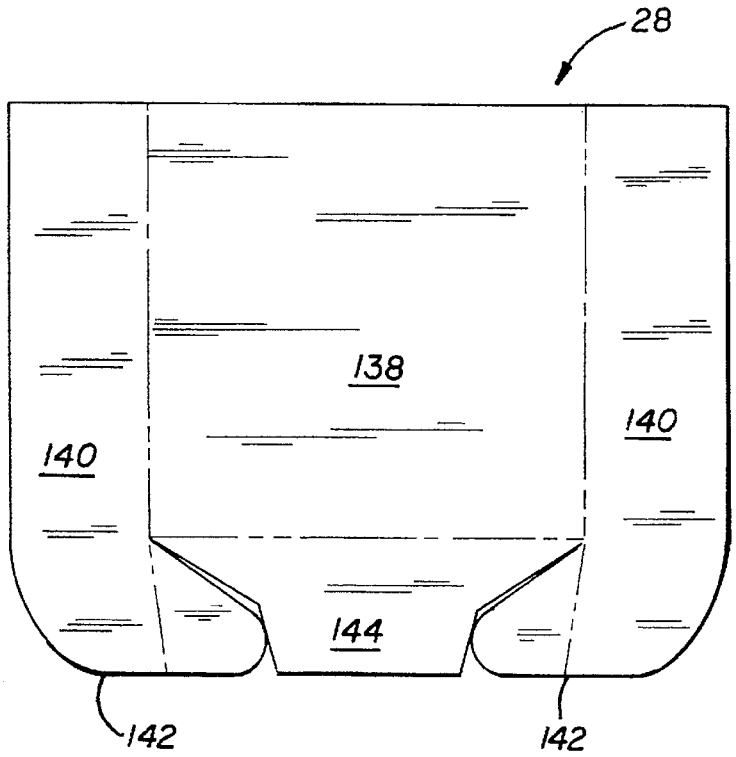
FIG. 11 is a plan view of an unfolded paperboard blank from which the header is constructed.

The blank (FIG. 11) for the header 28 includes a relatively large square main panel 138 joined on the vertical edges thereof to a pair of long narrow substantially rectangular side panels 140. Each of the side panels 140 terminates at a lower end in a bifold tab 142 that curves inwardly. A flap 144 is joined to the lower horizontal edge of the main panel 138 between the bifold tabs 142. The shape of the flap 144 generally conforms to the outline of the inside edges of the bifold tabs 142.

Once all the blanks have been folded into the respective components, the display may be assembled from the components as shown best in FIGS. 5 and 6. To connect the trays 24 to the base 22, the stacking members 107 of the rear portion of the base 32 are press fit upwardly into opposite vertical slots 130 of the lowest tray. To stack trays on top of each other, as shown in FIG. 6, a pair of column-forming members 26 are press fit downwardly into the opposite vertical slots 130 of the tray 24. For stability and appearance, the cut-out 122 in the sidewall of the tray should be the uppermost sidewall.

Once the column-forming members 26 have been installed, a second tray 24 may be placed over the exposed upper halves of the column-forming members 26 to rest on the sidewall 110 of the tray 24 below. If additional trays are desired for additional display space, column-forming members 26 are used in the same manner as described here. The column-forming members 26 form vertical columns. If desired, the header 28 may be interlocked with the uppermost tray by folding the bifold tabs 142 and press fitting them as shown in FIG. 5 into the vertical slots 130 of the uppermost tray. The flap 144 is tucked inwardly between the bifold tabs 142 and underneath the header main panel 138 as shown best in FIGS. 4 and 5. The header may contain merchandising information such as, for example, trademark, manufacturer's name, etc.

In an alternative embodiment as shown in FIGS. 12–14, the merchandising display may also be used on a counter 146 or the like. At least one tray 24 is secured by the tray attachment tabs 108 to a generally triangular-shaped easel 148, the blank for which is shown in FIG. 12. The easel blank includes a relatively small rectangular center panel 150. The longer sides are joined to triangular-shaped panels 152. The triangular-shaped panels each include a finger opening 154 and a narrow slot 156, the purposes for which will be described hereinafter. The shorter sides of the center panel are joined to bevelled borders 50. The triangular-shaped panels 152 have a first side 158 joined to the center panel 150, a longer second side 160 joined to a first flap 162 and a third side 164 joined to a second flap 166. The first flaps 162 are configured to interlock with each other when the easel 148 is assembled. First flap **162*a* includes a tab 168 formed from a cut-out in first flap 162*b*. Second flaps 166** are wing-shaped.

To assemble the counter display, the easel 148 is folded along the score lines. When assembled, the center panel 150 becomes the sloped roof of the easel. The two triangular-shaped panels 152 become the easel sides. The second sides 160 of the triangular-shaped panels abut the counter surface. The first flaps when interlocked form the floor of the easel. The slots 156 become diagonally oriented when the easel is positioned on the counter. The second flaps 166 and borders 50 are bent inwardly at a 90 degree angle. As best seen in FIG. 13, the tray 24 is positioned against the second flaps 166 and the attachment tabs 108 are secured into the slots 156 in the triangular-shaped panels 152. Placement of the tray holds the second flaps and border together. The finger opening 154 in each of the triangular-shaped panels makes it easier to hold the easel 148 when disassembly is desired. The easel 148 is used on the counter or the like to prop up the at least one tray holding the merchandise as shown in FIG. 14.

From the foregoing, it is to be appreciated that the merchandising displays of the present invention are versatile. The floor display is stable even when the trays are stacked to considerable height and filled with merchandise. It should of course be realized the the wider the base, the heavier the merchandise and the taller and wider the display can be. The floor display can be easily changed to a counter display using the same tray component. When use of either the floor or counter display is no longer desired, each of the components can be unfolded into the blanks that are relatively flat and quite easily stored and moved from one location to another.

Although particular embodiments of the invention have been described in detail for purposes of illustration, various modifications may be made without departing from the spirit and scope of the invention. Accordingly, the invention is not to be limited, except as by the appended claims.

What is claimed is:

1. A merchandising display, comprising:

a base having a pair of upstanding stacking members, and a front portion and a separate rear portion each formed from a paperboard blank, wherein the base front portion and rear portion interlock with each other by a plurality of tabs and slots; and at least one tray interlocked and mounted on the stacking members, wherein the tray is formed from a folded paperboard blank.

2. The merchandising display of claim 1, further comprising means for interlocking and mounting at least one additional tray in vertical stacked relation onto said one tray.

3. The merchandising display of claim 2, wherein each of the paperboard blanks from which said trays are formed is folded upon itself to form slots, these slots being vertically aligned when the trays are stacked, said interlocking means comprising column-forming members receivable into said slots.

4. The merchandising display of claim 3, wherein the column-forming members are formed from paperboard blanks.

5. The merchandising display of claim 4, wherein the column-forming members form continuous vertical columns by which a plurality of trays are stacked in succession.

6. The merchandising display of claim 3, further comprising a header for displaying information, the header having a pair of bifold tabs that interlock with the uppermost tray by press fitting the tabs into the slots of the uppermost tray.

7. The merchandising display of claim 1, wherein the base has a generally triangular-shaped side profile.

8. The merchandising display of claim 1, wherein the tabs on said base front portion are received in corresponding slots in the base rear portion.

9. The merchandising display of claim 1, wherein the said plurality of tabs and slots include at least one vertical tab and slot and at least one horizontal tab and slot.

10. The merchandising display of claim 1, wherein a series of tabs on the base rear portion are received in a series of parallel vertical slots having diagonally turned corners in the base rear portion to lock the rear portion together.

11. The merchandising display of claim 1, wherein the base comprises an easel.

12. The merchandising display of claim 11, wherein the tray interlocks and mounts to the easel by a pair of attachment tabs in a rear wall of the tray.

13. The merchandising display of claim 11, wherein the easel is formed from a folded paperboard blank.

14. A merchandising display, comprising:

a base having a pair of upstanding stacking members, and a front portion and a separate rear portion each formed from a paperboard blank, wherein a series of tabs on the base rear portion are received in a series of parallel vertical slots having diagonally turned corners in the base rear portion to lock the rear portion together; and at least one tray interlocked and mounted on the stacking members, wherein the tray is formed from a folded paperboard blank.

15. A merchandising display, comprising:

a base having a pair of upstanding stacking members and an easel; and at least one tray interlocked and mounted on the stacking members, wherein the base and tray are formed from folded paperboard blanks, and wherein the tray interlocks and mounts to the easel by a pair of attachment tabs in a rear wall of the tray.

16. The merchandising display of claim 15, wherein the easel is formed from a folded paperboard blank.

* * * * *